US005910792A

United States Patent [19]

Hansen et al.

[11] Patent Number: 5,910,792

[45] Date of Patent: Jun. 8, 1999

[54] METHOD AND APPARATUS FOR BRIGHTNESS CONTROL IN A FIELD EMISSION DISPLAY

[75] Inventors: Ronald L. Hansen, San Jose; Christopher J. Spindt, Menlo Park, both of Calif.

[73] Assignee: Candescent Technologies, Corp., San Jose, Calif.

[21] Appl. No.: 08/969,073

[22] Filed: Nov. 12, 1997

[51] Int. Cl.[6] ..... G09G 3/22

[52] U.S. Cl. ..... 345/74; 345/55; 345/75; 345/77; 315/167; 315/169

[58] Field of Search ..... 345/55, 58, 77, 345/75, 74, 89, 100, 205; 325/167, 169

[56] References Cited

U.S. PATENT DOCUMENTS

| | | | |
|---|---|---|---|
| 3,982,063 | 9/1976 | Brown et al. | 178/6 |
| 4,694,225 | 9/1987 | Tomii et al. | 315/366 |
| 5,103,145 | 4/1992 | Doran | 315/381 |
| 5,194,780 | 3/1993 | Meyer | 315/169 |
| 5,262,698 | 11/1993 | Dunham | 345/169 |
| 5,357,172 | 10/1994 | Lee et al. | 315/167 |
| 5,428,370 | 6/1995 | Knapp et al. | 345/205 |
| 5,459,480 | 10/1995 | Browning et al. | 345/75 |
| 5,600,345 | 2/1997 | Dingwall et al. | 345/100 |
| 5,625,373 | 4/1997 | Johnson | 345/58 |
| 5,708,451 | 1/1998 | Baldi | 345/75 |

*Primary Examiner*—Richard A. Hjerpe
*Assistant Examiner*—Henry N. Tran
*Attorney, Agent, or Firm*—Wagner, Murabito & Hao

[57] ABSTRACT

A method and apparatus to provide performance adjustments for FEDs during operation are provided. More specifically, the present invention provides two circuit embodiments for compensating for temperature induced brightness variations of the panel display. In a closed loop embodiment, a sample display circuit that is substantially similar to a FED being adjusted is used to generate a performance indicator signal which is compared against a reference signal to determine a difference signal. The difference signal is then used to adjust the operation performance of the FED as well as the sample display circuit. In an open loop embodiment, a current source generates a reference current across a sample resistor which is made from the same material as the resistor layer inside the FED's cathode. The voltage across the sample resistor is compared against a reference signal to determine a difference signal. The difference signal is then used to increase or decrease the brightness of the panel display, as needed, to compensate for temperature induced variations or other types of environment induced variations (e.g., humidity, aging, mild voltage drift that creates undesirable current drift, etc.) thereof.

20 Claims, 7 Drawing Sheets

306

306'

METHOD AND APPARATUS FOR BRIGHTNESS CONTROL IN A FIELD EMISSION DISPLAY

BACKGROUND OF THE INVENTION

1. Field of the Invention

The invention generally relates to flat panel display screens, and more particularly relates to flat panel field emission displays (FEDs).

2. Prior Art

Cathode ray tube (CRT) displays generally provide the best brightness, highest contrast, best color quality, and largest viewing angle of prior art displays. CRT displays typically use a layer of phosphor which is deposited on a thin glass faceplate. These CRTs generate a raster image by using electron beams which generate high energy electrons that are scanned across the faceplate in a desired pattern. The electrons excite the phosphor to produce visible light which in turn form the desired image. However, CRT displays are large and bulky. Hence, numerous attempts are being made to devise a commercially practical flat panel display that has comparable performance as a CRT display but is more compact in size and weight.

Flat panel field emission displays (FEDs) meet the above requirements and therefore are the potential replacement for CRT displays. Reference is now made to FIG. 1 illustrating a cross sectional view of a portion of a typical FED. As shown in FIG. 1, FED 100 comprises field emission cathode 101, faceplate 102, anode 103, phosphor layer(s) 104, and spacers 105.

Field emission cathode 101 comprises baseplate 106, emitters 107, row electrodes 108, column electrodes (also known as gate electrodes) 109, insulating layer 110, and resistor layer 111. Row electrodes 108 are on top of baseplate 106. Resistor layer 111 is electrically connected to row electrodes 108. Insulating layer 110 is attached on top of resistor layer 111. Insulating layer 110 is made out of a dielectric material to electrically insulate resistor layer 111 from column electrodes 109 that are attached on top of insulating layer 110. Column electrodes 109 have cutouts 112 providing clear paths between emitters 107 and phosphor layers 104. Emitters 107 are formed on and are electrically connected to resistor layer 111.

Faceplate 102 forms a sealed enclosure with baseplate 106. Typically, faceplate 102 is made of glass and is spaced apart from baseplate 106. Anode 103 is layered on top of faceplate 102. Phosphor layers 104 are deposited on top of anode 103. Spacers 105 help keep faceplate 102 a required distance apart from baseplate 106 against the force of outside atmospheric pressure.

A control circuit controls voltage levels of row electrodes 108 and column electrodes 109 to establish a bias voltage between emitters 107 and column electrodes 109. The voltage on column electrodes 109 (hereinafter known as gate voltage) creates an electric field which triggers emitters 107 to emit electrons. Upon being emitted, the electrons are attracted toward anode 103 due to its positive (+) polarity. When the electrons strike phosphor particles in phosphor layers 104 which are deposited on faceplate 102, visible light is produced to form images.

Resistor layer 111 helps to make the emission characteristic more spatially uniform so that pixel characteristics such as color, brightness, etc. are uniform throughout the display. Resistor layer 111 can be made out of a number of materials such as Cermet, silicon carbide, or a combination of both.

Since effects such as temperature change, contamination, etc. may cause the electrical characteristics of resistor layer 111 to vary during operation, the value of the resistance of resistor layer 111 can change which in turn can alter the slope of the cathode voltage-to-current curve. These variations in the resistor characteristics can cause the overall brightness of the FED screen to vary with the operational temperature. Accordingly, the brightness of the display can be adversely affected by changes in operating temperature of the FED.

In the Prior Art, to prevent such adverse effects, the resistor material is formulated to have near-zero temperature coefficient. However, the Prior Art techniques are difficult to carry out which cause manufacturing costs to increase. At the same time, the Prior Art techniques are generally not completely effective in preventing the adverse effects because the resistor material still has some variations with temperature.

As well, if the emission characteristic of the emitters 107 (FIG. 1) changes over time, due to contamination, erosion or other mechanisms, this can produce a corresponding change in display brightness. A cost effective method is needed to compensate for the changes in the emission characteristic.

Thus, a need exists for a less costly and more effective apparatus and method to provide brightness adjustments for FEDs operated over a range of temperatures and to compensate for the changes in the emission characteristic discussed above.

SUMMARY OF THE INVENTION

Accordingly, the present invention provides a less costly and more effective apparatus and method to compensate for brightness variations within FEDs during operation.

In one embodiment, the present invention meets the above need with a closed loop compensating circuit which comprises a sample display circuit, an error adjusting circuit, and an inverting circuit. The sample display circuit has substantially similar operating characteristics as the FED panel display. The error adjusting circuit receives a performance indication signal from the sample display circuit. Next, the error adjusting circuit determines a difference signal from the performance indication signal received and a reference signal. The error adjusting circuit then provides the difference signal to the FED and the sample display circuit.

The inverting circuit receives the difference signal from the error adjusting circuit and inverts the polarity of the difference signal. The inverting circuit provides the inverted difference signal to the panel display and the sample display circuit. The difference signal and the inverted difference signal are then used to cause electrical adjustments (e.g., column and row drive lines voltages) to be made in decreasing the difference signal.

In an alternate embodiment, the compensating circuit is an open loop compensating circuit which comprises a sample resistor, an error adjusting circuit, and an inverting circuit. The sample resistor is made from the same material as the resistor layer in the FED. The error adjusting circuit determines a difference signal between a signal across the resistor layer and a reference signal. The inverting circuit inverts the difference signal. The difference signal and the inverted difference signal are then used to cause electrical adjustments to be made in decreasing the difference signal.

In providing the above circuits, the present invention offers mechanisms for increasing or decreasing the brightness of an FED screen in response to temperature or emission characteristic induced brightness variations thereof.

The brightness is increased or decreased by controlling the voltage of the row and column drive lines of the FED screen.

All the features and advantages of the present invention will become apparent from the following detailed description of its preferred embodiment whose description should be taken in conjunction with the accompanying drawings.

BRIEF DESCRIPTION OF THE DRAWINGS

Prior Art

DETAILED DESCRIPTION OF THE INVENTION

In the following detailed description of the present invention, numerous specific details are set forth in order to provide a thorough understanding of the present invention. However, it will be obvious to one skilled in the art that the present invention may be practiced without these specific details. In other instances well known methods, procedures, components, and circuits have not been described in detail as not to unnecessarily obscure aspects of the present invention. It is to be appreciated that while the present invention is designed to compensate for environmentally induced effects (e.g., temperature) on the operation of FEDs, the present invention is clearly applicable for other environmentally induced effects as well such as humidity, aging, mild voltage drift that creates undesirable current drift, etc.

Figure 1:
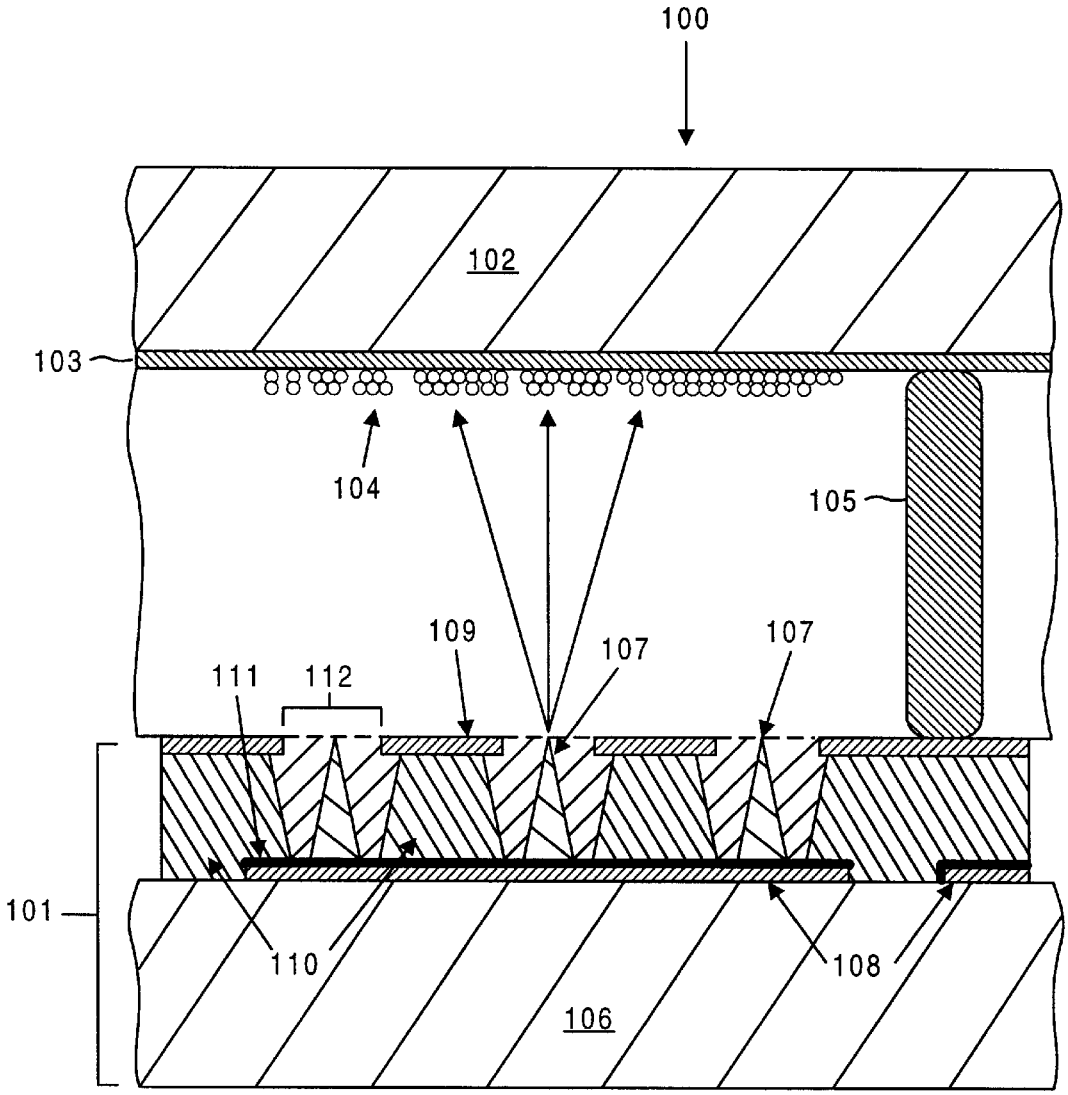
FIG. 1 (Prior Art)
FIG. 1 illustrates a cross sectional view of a typical flat panel field emission display (FED).
Figure 2:
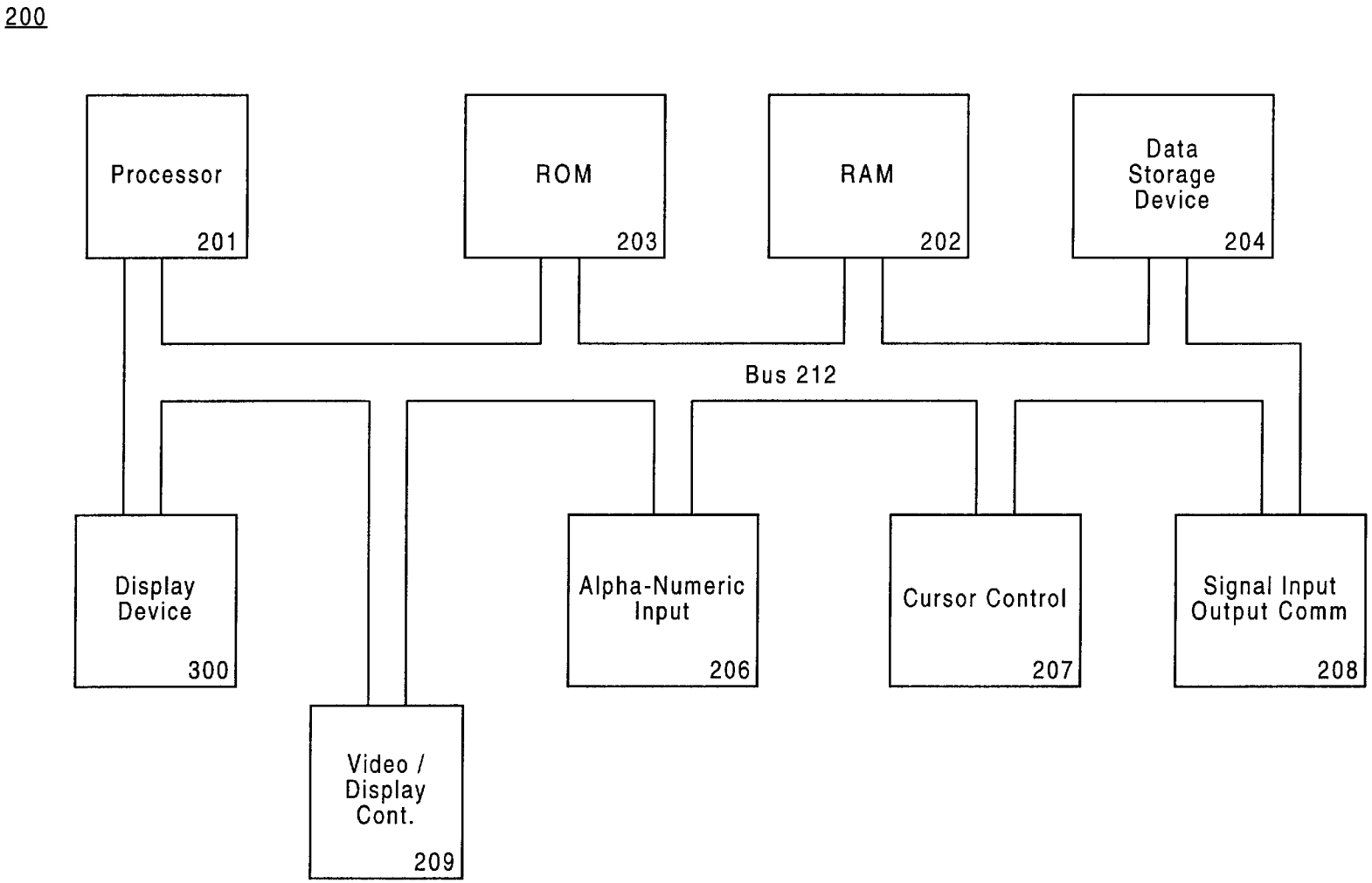
FIG. 2 illustrates a block diagram of typical computer system incorporating the present invention.

Reference is made to FIG. 2 illustrating a block diagram of a typical computer system 200 upon which the present invention may be implemented or practiced. It is to be appreciated that computer system 200 is exemplary only and that the present invention can operate within a number of different computer systems including general purpose computers systems, embedded computer systems, and others.

In general, computer system 200 used by the present invention comprises address/data bus 212 for conveying information and instructions, one or more processors 201 coupled with bus 212 for processing information and instructions, a random access memory (RAM) 202 for storing digital information and instructions, a read only memory (ROM) 203 for storing information and instructions of a more permanent nature. In addition, computer system 200 also includes a data storage device 204 (e.g., a magnetic, optical, floppy, or tape drive) for storing vast amounts of data, an I/O interface 208 for interfacing with peripheral devices (e.g., computer network, modem, etc.), and a display/video controller 209 for generating images for display by display device 300. Moreover, computer system 200 also has an alphanumeric input device 206 (e.g., keyboard) and a cursor control device 207 (e.g., mouse, track-ball, light-pen, etc.) for communicating user input information and command selections. In accordance with the present invention, display device 300 can be a FED.

Figure 3:
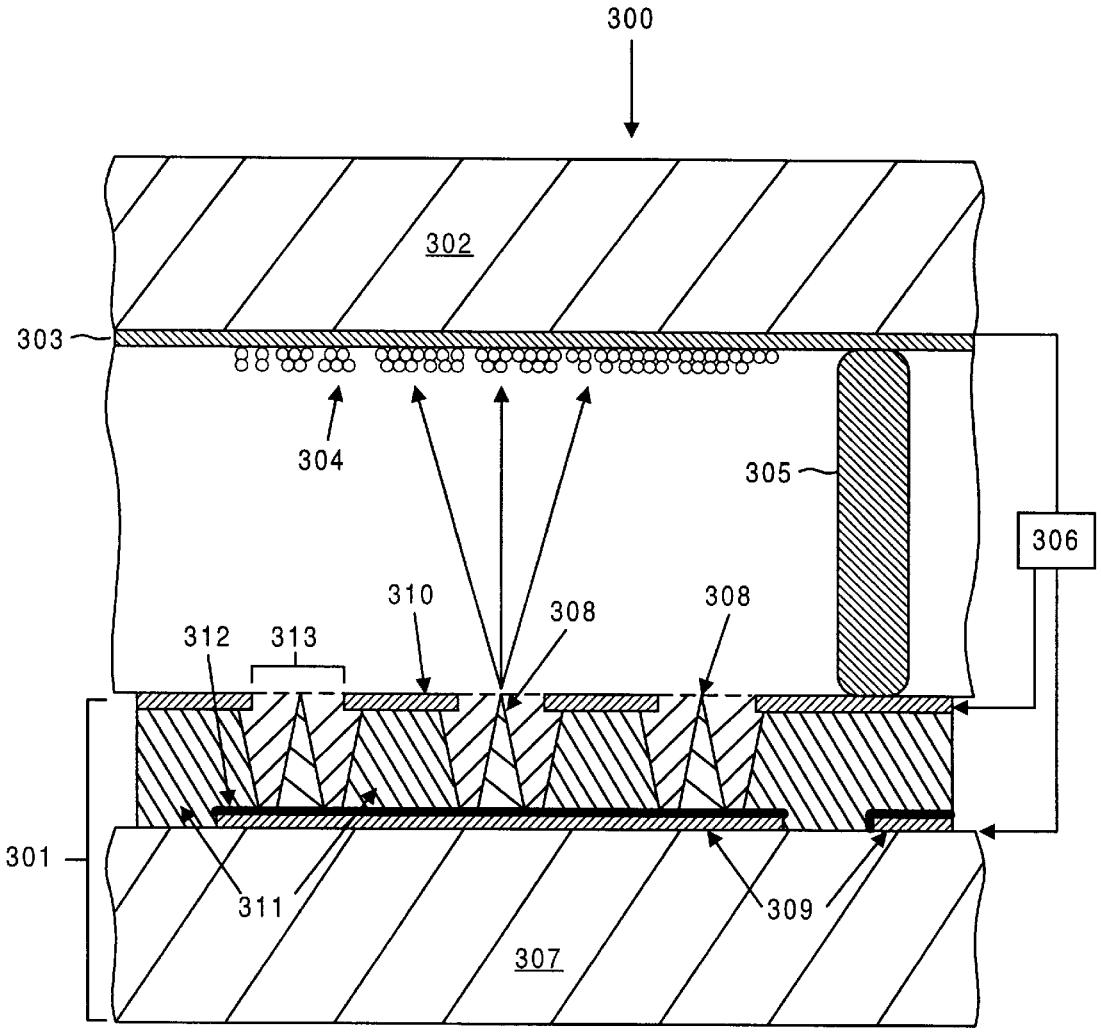
FIG. 3 illustrates a cross sectional view of a FED in accordance to the present invention.

Reference is now made to FIG. 3 illustrating a cross sectional view of an embodiment of a portion of FED 300 in accordance to the present invention. As shown in FIG. 3, FED 300 comprises field emission cathode 301, faceplate 302, anode 303, phosphor layer(s) 304, spacers 305, and compensating circuit 306.

Field emission cathode 301 comprises baseplate 307, emitters 308, row electrodes 309, column electrodes (also known as gate electrodes) 310, insulating layer 311, and resistor layer 312. Row electrodes 309 are on top of baseplate 307. Resistor layer 312 is electrically connected to row electrodes 309. Insulating layer 311 are attached on top of resistor layer 312. Insulating layer 311 is made out of a dielectric material to electrically insulate resistor layer 312 from column-electrodes 310 that are attached on top of insulating layer 311. Column electrodes 310 have cutouts 313 to provide clear paths between emitters 308 and phosphor layers 304. Emitters 308 are formed on and are electrically connected to resistor layer 312.

Faceplate 302 forms a sealed enclosure with baseplate 307. Typically, faceplate 302 is made of glass and is spaced apart from baseplate 307. Anode 303 is layered on top of faceplate 302. Phosphor layers 304 are deposited on top of anode 303. Spacers 305 help keep faceplate 302 a required distance apart from baseplate 307 against the force of outside atmospheric pressure.

Control circuits (shown in FIG. 4) control voltage levels of row electrodes 309 and column electrodes 310 to establish a bias voltage between emitters 308 and column electrodes 310. The voltage on column electrodes 310 (hereinafter known as gate voltage) creates an electric field which triggers emitters 308 to generate electrons. Upon being generated, the electrons are attracted toward anode 303 due to its positive (+) polarity. When the electrons strike phosphor particles in phosphor layers 304 which are deposited on faceplate 302, visible light is produced to form images.

Resistor layer 312 of FIG. 3 helps to make the emission characteristic more spatially uniform so that pixel characteristics such as color, brightness, etc. can be maintained uniformly throughout the display. Resistor layer 312 can be made out of a number of materials such as Cermet, silicon carbide, or a combination of both. Since temperature changes may cause the electrical characteristics of resistor layer 312 to change, compensating circuit 306 is provided to compensate for these changes in accordance to the present invention.

Figure 4:
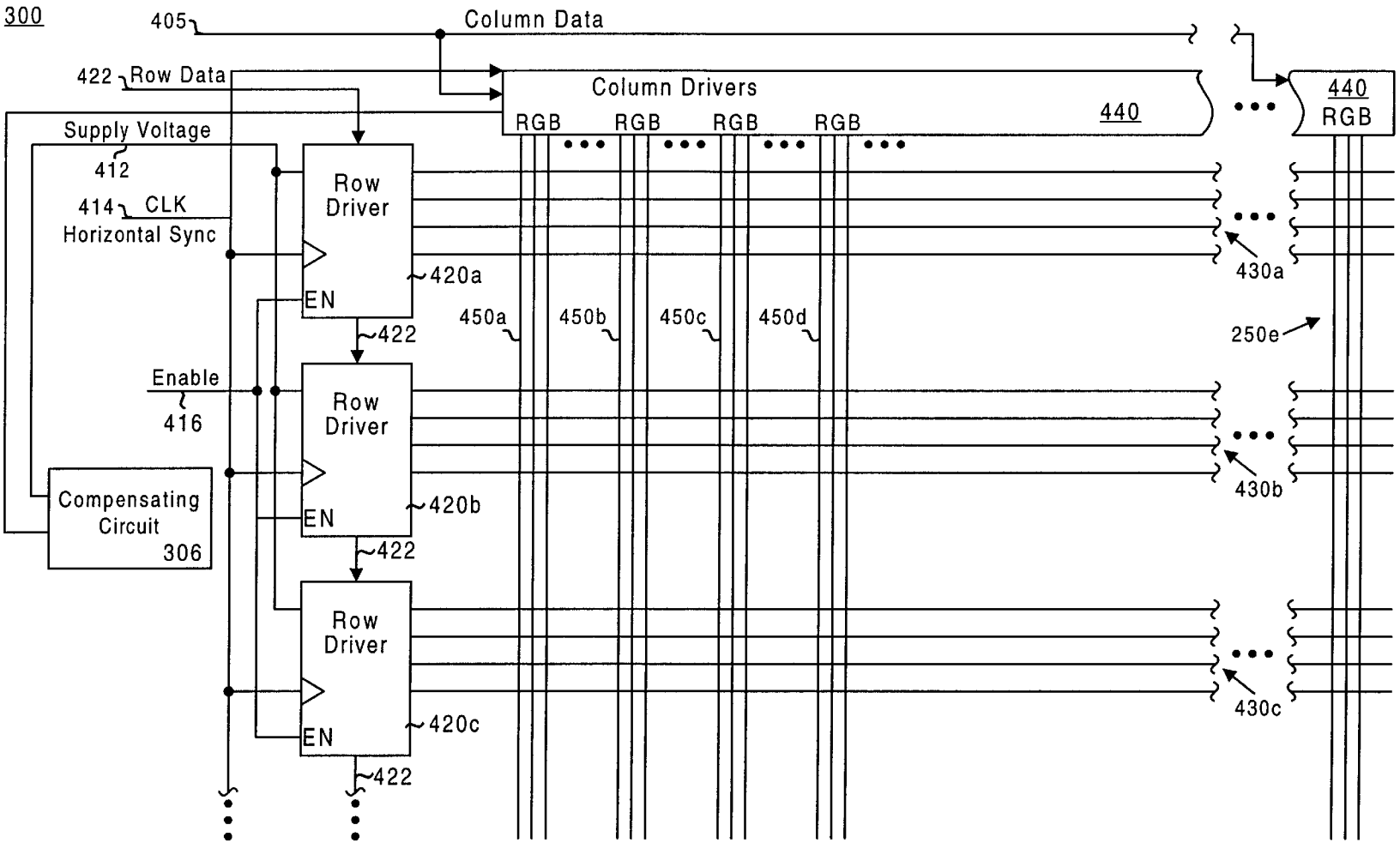
FIG. 4 illustrates a plan view of a FED having row and column drivers and numerous intersecting rows and columns.

Referring now to FIG. 4 illustrating a plan view of FED 300. As shown in FIG. 4, FED 300 consists of n row lines (horizontal), x column lines (vertical), and compensating circuit 306. For clarity, a row line is called a "row" and a column line is called a "column". Row lines are driven by row driver circuits 420*a*–420*c*. Shown in FIG. 4 are row groups 430*a*, 430*b*, and 430*c*. Each row group is associated with a particular row driver circuit. There are three row driver circuits, 420*a*–420*c*, shown in FIG. 4. In one embodiment of the present invention, there are over 400 rows and approximately 5–10 row driver circuits. However, it is appreciated that the present invention is equally well suited to an FED flat panel display screen having any number of rows. Also, FIG. 4 shows column groups 450*a*–450*d*. In one embodiment of the present invention, there are over 1920 columns. However, it is appreciated that the present invention is equally suited to an FED flat panel display screen having any number of columns. Since a pixel requires three columns (red, green, blue), 1920 columns provide at least 640 pixel resolution horizontally.

Row driver circuits 420*a*–420*c* are placed along the periphery of FED 300. In FIG. 4, only three row drivers are shown for clarity. Each row driver 420*a*–420*c* is responsible for driving a group of rows. For instance, row driver 420*a* drives row group 430*a*, row driver 420*b* drives row group 430*b*, and row driver 420*c* drives row group 430*c*. Although an individual row driver is responsible for driving a group of rows, only one row is active at a time across the entire FED 300. Therefore, an individual row driver drives at most a row line at a time, and when the active row line is not in its group during a refresh cycle, it is not driving any row line. A supply voltage line 412 is coupled in parallel to all row driver 420*a*–420*c* and supplies the row drivers with a driving voltage for application to the cathode of the emitters.

An enable signal is also supplied to each row driver 420*a*–420*c* in parallel over enable line 416 of FIG. 4. When enable line 416 is low, all row drivers 420*a*–420*c* of FED screen 300 are disabled and no row is energized. When enable line 416 is high, row drivers 420*a*–420*c* are enabled. A horizontal clock signal is also supplied to each row driver 420*a*–420*c* in parallel over clock line 414 of FIG. 4. The horizontal clock signal or synchronization signal pulses upon each time a new row is to be energized. The n rows of a frame are energized, one at a time, to form a frame of data.

In general, all row drivers of FED 300 are configured to implement one large serial shift register having n bits of storage, one bit per row. Row data is shifted through these row drivers using a row data line 422 that is coupled to row driver circuits 420*a*–420*c* in serial fashion.

As shown in FIG. 4, there are three columns per pixel within FED 300. Column lines 450*a* control one column of pixels, column lines 450*c* control another column line of pixels, etc. FIG. 4 also illustrates the column drivers 440 that control the gray-scale information of each pixel. The column drivers 440 drive amplitude modulated voltage signals from supply voltage signal 418 to the column lines. In an analogous fashion to the row driver circuits, column drivers 440 can be broken into separate circuits that each drive groups of column lines. The amplitude modulated voltage signals driven over the column lines 450*a*–450*e* represent gray-scale data for a respective row of pixels. Once every pulse of the horizontal clock signal at line 414, column drivers 440 receive gray-scale data to independently control all of column lines 450*a*–450*e* of pixel row of the FED flat panel display screen 300. However, only one row is energized during the on-time window. The horizontal clock signal over line 414 synchronize the loading of a pixel row of gray-scale data into the column drivers 440.

Different voltages are applied to the column lines to realize different gray scale colors. In operation, all column lines are driven with gray-scale data and simultaneously one row is activated. This causes a row of pixels to illuminate with the proper gray-scale data. This is then repeated for another row, etc., once per pulse of the horizontal clock signal of line 414, until the entire frame is filled. To increase speed, while one row is being energized, the gray-scale data for the next pixel row is simultaneously loaded into the column drivers 440. Like row drivers 420*a*–420*c*, column drivers 440 assert their voltages within the on-time window. Further, like row drivers 420*a*–420*c*, column drivers 440 have an enable line.

Figure 5:
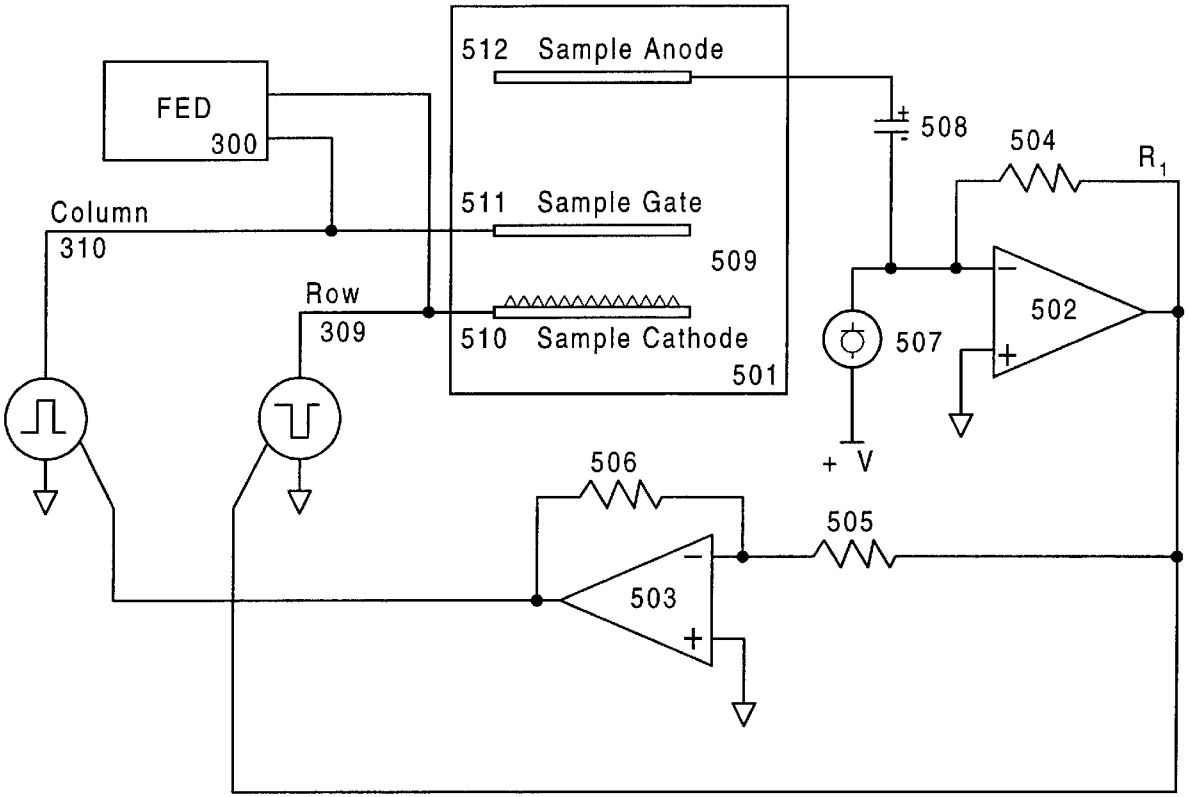
FIG. 5 illustrates the preferred embodiment of the compensating circuit of the present invention implemented in the FED of FIG. 3.

FIG. 5 illustrates the preferred embodiment of compensating circuit 306, a closed-loop error correction circuit, in accordance to the present invention. As shown in FIG. 5, compensating circuit 306 comprises sample FED display circuit 501, operational amplifiers (hereinafter op-amps) 502–503, resistors 504–506, current source 507, and DC power supply 508. Sample FED display circuit 501 is an operational and representative model of FED 300 and is made up of sample cathode 509, emitters 510, sample gate 511, and sample anode 512. Sample cathode 509 comprises row electrodes and a resistor layer that is made out of the same material as that of resistor layer 312 of FED 300. Sample cathode 509 may further comprise other structural layers of other materials that might be subject to temperature induced effects. Emitters 510 are formed on top of and are electrically connected to sample cathode 509. Sample gate 511 is made up of column electrodes with cutouts to allow emitters 510 a path to sample anode 512.

Op-amp 502 is a standard op-amp with high gain and low offset. Sample anode 512 is electrically connected to power supply 508 which in turn is connected to the negative input of op-amp 502. Current source 507 is connected together with power supply 508, to the negative input of op-amp 502. The positive input of op-amp 502 is connected to ground. The output of op-amp 502 is connected to feedback resistor 504 which in turn is connected to the negative input of op-amp 502. It is important that both current source 507 and feedback resistor 504 are temperature stable (i.e., not temperature sensitive). Additionally, the inputs of op-amp 502 are also temperature insensitive. It should be clear to one of ordinary skill in the art that depending on the characteristic being in monitored, the characteristics of current source 507 and feedback resistor 504 can be altered to so reflect.

As configured, op-amp 502 is a current-to-voltage converter. In other words, the difference between the current (e.g., a performance indicator) from sample anode 512 and a reference (e.g., constant) current from current source 507 is multiplied by feedback resistor 504 to determine the voltage at the output of op-amp 502.

The output of op-amp 502 is connected to resistor 505 which in turn is connected to the negative input of op-amp 503. The output of op-amp 503 is connected to resistor 506 which in turn is also connected to the negative input of op-amp 503. The positive input of op-amp 503 is connected to ground. As configured, op-amp 503 is an inverting amplifier. The values of resistors 505–506 can be selected to generate various gain amounts as desired.

The output of op-amp 502 is connected to sample cathode 509 and to row electrodes 309. The output of op-amp 503 is connected to sample gate 511 and to column electrodes 310. Since the bias voltage between sample gate 511 and sample cathode 509 is used of control the emission of electrons by emitters 510, the control polarities of sample gate 511 and sample cathode 509 are opposite of each other. Similarly, the drive polarities of column electrodes 310 and row electrodes 309 are opposite of each other. In the preferred embodiment, while the polarity of sample cathode 509 and of row electrodes 309 are negative, the polarity of sample gate 511 and of column electrodes 310 are positive. It is to be appreciated that the present invention also applies if the control polarity is reversed to accommodate the inverted cathode-gate configuration.

The present invention operates as follows, emitters on sample cathode 509 emit electrons that are selectively allowed by sample gate 510 to pass through to sample anode 511. Sample anode 511 collects the electrons emitted and sends these electrons to op-amp 502 as a current. This current is compared against a reference current from current source 507. Because current source 507 is temperature insensitive, if there is a difference between the two currents indicating there are temperature induced effects causing a degradation in the display performance (e.g., brightness), op-amp 502 converts the current difference into voltage and sends it to row electrodes 309 via supply voltage signal 412 to make the required correction. At the same time, the voltage output from op-amp 502 is sent to op-amp 503 which inverts the polarity of the voltage and sends it to column electrodes 310 via supply voltage signal 418 to make the required correction. Since the outputs of op-amps 502–503 are also connected to sample cathode 509 and sample gate 510, respectively, compensating circuit 306 is a closed-loop control circuit. As such, the difference between the two currents is also used to make corresponding correction in sample cathode 509 and sample gate 510 to drive the difference to zero.

It is to be appreciated that since closed-loop compensating circuit 306 of the present invention controls the current generated between the anode and cathode, compensating circuit 306 not only has the ability to correct temperature induced effects, but any changes in emission characteristics of the display structure such as contamination of emitter tips, effect due to aging, etc.

Figure 6:
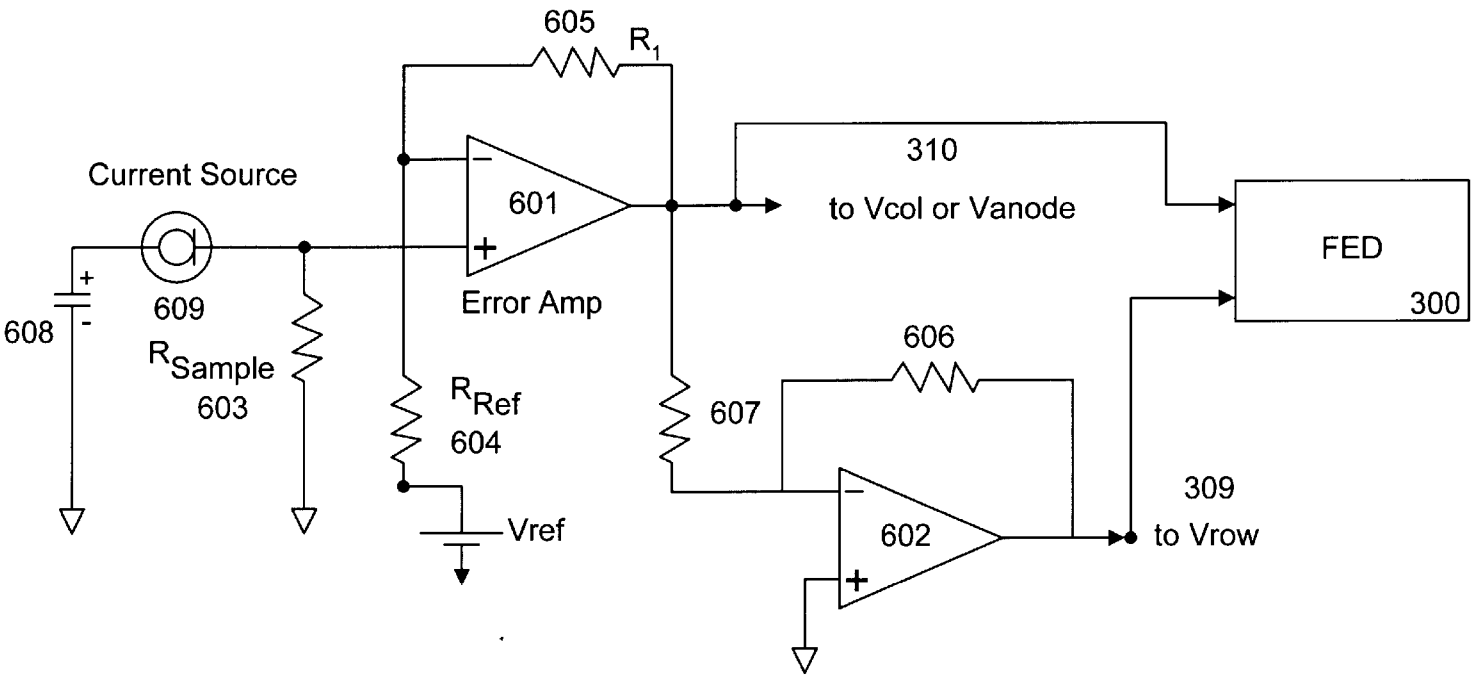
FIG. 6 illustrates an alternate embodiment of the compensating circuit of the present invention implemented in the FED of FIG. 3.

Reference is now made to FIG. 6 illustrating an alternate embodiment of compensating circuit 306', an open-loop error correction circuit, in accordance to the present invention. As shown in FIG. 6, compensating circuit 306' comprises op-amps 601–602, resistors 603–607, current source 609, and DC power supply 608.

Power supply 608 is connected on one end to ground. The other end of power supply 608 is connected to current source 609. In turn, current source 609 is connected to the positive input of op-amp 601 which is a standard op-amp with high gain and low offset. Sample resistor 603, which has the same electrical properties and characteristics (e.g., temperature coefficient) as the material used in resistor layer 312, is connected at one end to ground. The other end of resistor 603 is connected with current source 609 to the positive input of op-amp 601. Reference resistor 604 is connected at one end to a reference voltage and to the negative input of op-amp 601 at the other end. The output of op-amp 601 is connected to resistor 605 which in turn is also connected to the negative input of op-amp 601. It is important that both current source 609 and reference resistor 604 are temperature stable (i.e., not temperature sensitive). Additionally, the inputs of op-amp 601 are also temperature insensitive. It should be obvious to one of ordinary skill in the art that depending on the characteristic being in monitored (e.g., impurity), the characteristics of current source 609, sample resistor 603, and reference resistor 604 can be altered to so reflect.

As configured, op-amp 601 of FIG. 6 is essentially an error amplifier. The voltage across sample resistor 603 is amplified by the combination of parallel resistors 604 and 605. Power supply 608 is used to provide a constant source voltage for current source 609. The output of op-amp 601 is provided as either the column electrodes voltage or the anode voltage control. The output of op-amp 601 is also connected to resistor 607 which in turn is connected to the negative input of op-amp 602. The output of op-amp 602 is connected to resistor 606 which in turn is also connected to the negative input of op-amp 602. The positive input of op-amp 602 is connected to ground. As configured, op-amp 602 is an inverting amplifier. The values of resistors 606–607 can be selected to generate any kind of gain desired.

The output of op-amp 602 is provided as the row electrodes voltage. Since the bias voltage between row electrodes 309 and column electrodes 310 is used to establish a bias voltage between emitters 308 and column electrodes 310, the polarities of row electrodes 309 and column electrodes 310 are opposite of each other. In the preferred embodiment, while the polarity of row electrodes 309 are negative, the polarity of column electrodes 310 are positive. It is to be appreciated that the present invention also applies if this polarity is reversed. Because the output of op-amp 601 can be provided to either column electrodes 310 or anode 303 and the output of op-amp 602 is provided to row electrodes 309, compensation can be made to the column power supply, row power supply, anode (faceplate High voltage) power supply, or any combination of these power supplies.

The embodiment of FIG. 6 operates as follows, a predetermined current from current source 609 flows through sample resistor 603 to generate a voltage proportional to the resistance of resistor 603 and the value of the predetermined current, to the positive input of op-amp 601. This voltage is compared against a reference voltage applied across reference resistor 604. Because of the temperature sensitivity of the sample resistor 603, if there is a difference between the two voltages indicating there are temperature induced effects causing a change in the display performance (e.g., brightness), op-amp 601 amplifies the voltage difference and sends it to column electrodes 310 via supply voltage signal 418 or anode 303 to make the required correction. At the same time, the voltage output from op-amp 601 is sent to op-amp 602 which inverts the polarity of the voltage and sends it to row electrodes 310 via supply voltage signal 412 to make the required correction. As such, the alternate embodiment of compensating circuit 306 is an open-loop compensation circuit.

Figure 7:
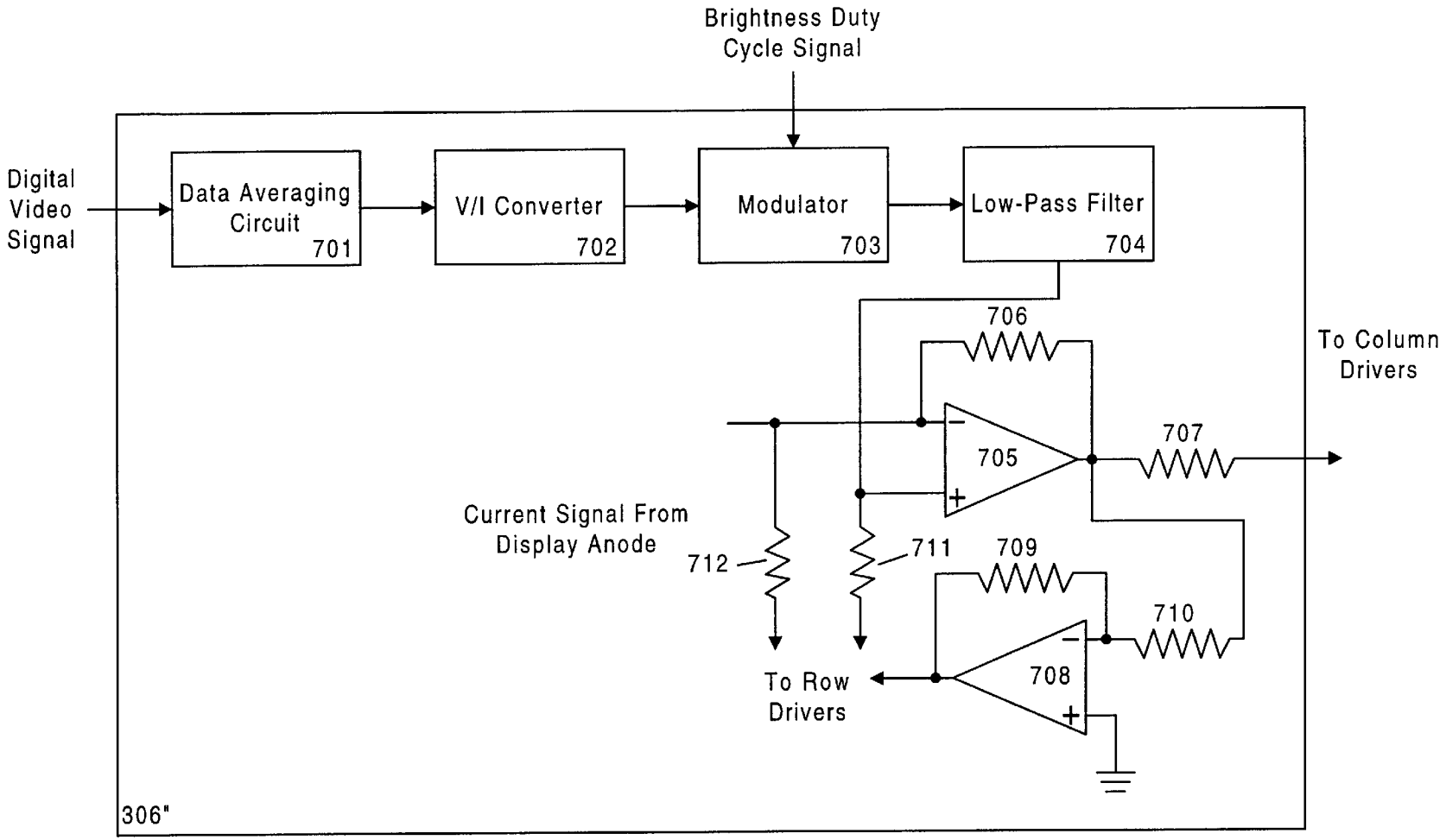
FIG. 7 illustrates another alternate embodiment of the compensating circuit of the present invention implemented in the FED of Figure.

Reference is now made to FIG. 7 illustrating another alternate embodiment of compensating circuit 306", a closed-loop error correction circuit, in accordance to the present invention. As shown in FIG. 7, compensating circuit 306" comprises data average circuit 701, an analog V/I (voltage/current) converter 702, modulator 703, low-pass filter 704, op-amp 705, resistors 706–707, op-amp 708, and resistors 709–712.

A signal carrying red-green-blue (RGB) digital video data from display/video controller 209 is provided as input to data average circuit 701 which produces a voltage signal that is the long-term average of all the RGB digital data. Additionally, the data average circuit acts as a very low frequency low-pass filter for the RGB signal. The output of data average circuit 701 is then provided to analog V/I converter 702 which converts the averaged RGB digital data signal into an analog signal. This analog signal is delivered to a Gamma 2.3 voltage-to-current converter. Essentially, the output signal from analog V/I converter 702 is a voltage that represents what an ideal emitter would produce. In short, analog V/I converter 702 converts "full white" RGB data into a voltage representing "full bright" current.

The analog signal from analog V/I converter 702 is provided as an input to modulator 703 which modulates this signal using a brightness (contrast) duty cycle signal, which is set by a display user, as a control signal. The modulated analog current signal is then provided to low-pass filter 704 to further eliminate undesirable high-frequency components. The output of low-pass filter 704 is provided to the positive (+) input of op-amp 705. On one end, feedback resistor 706 is connected to the negative (−) input of op-amp 705. The other end of resistor 706 is connected to the output of op-amp 705. The output of op-amp 705 is in-turn connected to resistor 707. A voltage signal that represents the actual anode current from FED 300 is provided to the negative (–) input of op-amp 705. Resistor 711 is connected between the positive (+) input of op-amp 705 and ground. The resistor 712 is connected between the negative (–) input of op-amp 705 and ground.

As configured, op-amp 705 and resistor 706 of FIG. 7 are essentially a voltage error amplifier. The error amplifier first determines the difference (error) between a voltage that represents the actual anode current against a voltage that represents the ideal anode current. The difference (error) between the actual anode current and the current from the modulated analog video signal is then converted into a difference voltage and amplified by the gain of the op-amp 705. The value of resistor 706 can be selected to generate any kind of gain desired. The amplified voltage difference is then supplied to column drivers 440 in a direction that strives to maintain a zero (0) error. The amplified voltage difference is also supplied to the negative (–) input of op-amp 708 through resistor 710. The negative (–) input of op-amp 708 is also connected to resistor 709 which in turn is connected to the output of op-amp 708. The positive (+) input of op-amp 708 is connected to ground.

As configured, op-amp 708 together with resistors 709–710 make up an inverter which inverts the output of the current error amplifier. The values of resistors 709 and 710 are selected to generate a gain of approximately 1. The output of op-amp 708 is supplied to row drivers 420*a*–420*c* in a direction that strives to maintain a zero (0) error.

It is to be appreciated that the current invention as represented by the three embodiments discussed above is designed for a long period correction whose duration ranges from several seconds to a few minutes. The current invention is not intended for "real-time" compensation (i.e., with corrections on a sub-second time scale). For examples, the current invention can compensate for temperature effects in the cathode with time constants in the order of 10's to 100's of seconds and compensate for cathode aging effects with time constants in the order of 10's to 1000's hours.

The preferred embodiment of the present invention, an apparatus to compensate an FED for variation in brightness caused by temperature during operation, is thus described. While the present invention has been described in particular embodiments, the present invention should not be construed as limited by such embodiments, but rather construed according to the below claims.

What is claimed is:

1. An apparatus to compensate a panel display for brightness variations during operation, the apparatus comprising:

a panel display wherein the panel display is a flat panel field emission display (FED) comprising a resistor layer electrically connected to row electrodes;

a sample display circuit having substantially similar operating characteristics as the panel display, wherein the sample display circuit comprises: a sample cathode; emitters; a sample gate; and a sample anode and wherein the sample cathode comprises: sample row electrodes; and a sample resistor layer;

an error adjusting circuit receiving a performance indication signal from the sample display circuit, the error adjusting circuit determining a difference signal from the performance indication signal and a reference signal, the error adjusting circuit providing the difference signal to the panel display and the sample display circuit; and an inverting circuit receiving the difference signal from the error adjusting circuit, the inverting circuit inverting the polarity of the difference signal, and providing the inverted difference signal to the panel display and the sample display circuit, wherein the difference signal and the inverted difference signal are for driving row lines and column lines of the panel display to compensate for brightness variations.

2. The apparatus of claim 1, wherein the resistor layer of the FED is made out of silicon carbide.

3. The apparatus of claim 2, wherein the sample resistor layer is made out of silicon carbide.

4. The apparatus of claim 3, wherein the error adjusting circuit comprises:

a first operational amplifier (op-amp);

a power supply connected between the sample anode and a negative (–) input of the first op-amp;

a current source connected to the negative (–) input of the first op-amp; and a feedback resistor connected between the negative (–) input and an output of the first op-amp, wherein a positive (+) input of the first op-amp is connected to ground, the output of the first op-amp is connected to the row electrodes and the sample cathode, the current source is temperature stable, the feedback resistor is temperature stable, and the positive and negative inputs of the first op-amp are temperature stable.

5. The apparatus of claim 4, wherein the inverting circuit comprises:

a second op-amp;

a first resistor connected to the output of the first op-amp and a negative (–) input of the second op-amp; and a second resistor connected between the negative (–) input and an output of the second op-amp, wherein a positive (+) input of the second op-amp is connected to ground, the output of the second op-amp is connected to the column electrodes and the sample gate.

6. An apparatus to compensate for brightness variations for a panel display having a resistor layer made from a resistor material, the apparatus comprising:

a panel display wherein the panel display is a flat panel field emission display (FED);

a sample resistor connected to a first voltage, the sample resistor made from the resistor material;

an error adjusting circuit connected to the sample resistor, the error adjusting circuit determining a difference signal between a signal conducted across the sample resistor and a reference signal, the error adjusting circuit providing the difference signal to the panel display, wherein the error adjusting circuit comprises:

a first operational amplifier (op-amp):

a power supply connected to the first op-amp:

a current source coupled between the power supply and a first input of the first op-amp:

a reference resistor coupled between a second input of the first op-amp and a reference voltage; and a resistor connected between the second input and the output of the first op-amp, wherein the sample resistor is coupled to the first input of the first op-amp and the output of the first op-amp is coupled to the column electrodes and an anode of the FED; and an inverting circuit receiving the difference signal from the error adjusting circuit and inverting the polarity of the difference signal, the inverting circuit providing the inverted difference signal to the panel display, wherein the difference signal and the inverted difference signal are for driving row lines and column lines of the panel display to compensate for brightness variations.

7. The apparatus of claim 6, wherein the resistor material of the FED is silicon carbide.

8. The apparatus of claim 6, wherein the first input of the first op-amp is the positive (+) input and wherein the second input is the negative (−) input and wherein the current source is temperature stable, the reference resistor is temperature stable, and the positive and negative inputs of the first op-amp are temperature stable.

9. The apparatus of claim 8, wherein the inverting circuit further comprises:

a second op-amp;

a first resistor connected to the output of the first op-amp and a negative (−) input of the second op-amp; and a second resistor connected between the negative (−) input and an output of the second op-amp, wherein a positive (+) input of the second op-amp is connected to the first voltage, the output of the second op-amp is connected to the row electrodes.

10. An apparatus to compensate a panel display for brightness variations during operation, the apparatus comprising:

a panel display wherein the panel display is a flat panel field emission display (FED) and wherein the FED further comprises a resistor layer electrically connected to row electrodes;

a converter circuit receiving as input a digital video signal and for converting the digital video signal to an analog video signal;

a modulator circuit receiving as input the analog video signal and for modulating the analog video signal using a brightness duty cycle to generate a modulated analog video signal;

an error adjusting circuit receiving as input the modulated analog video signal and a performance indication signal from the panel display, the performance indication signal indicating electrical variations of the resistor layer attributed to a temperature variation of the resistor layer, the error adjusting circuit determining a difference signal from the performance indication signal and the modulated analog video signal and providing the difference signal to the panel display; and an inverting circuit receiving the difference signal from the error adjusting circuit and for inverting the polarity of the difference signal and providing the inverted difference signal to the panel display, wherein the difference signal and the inverted difference signal are for driving column lines and row lines of the panel display to compensate for brightness variations therein.

11. The apparatus of claim 10 further comprising a data averaging circuit coupled between the digital video signal and the converter circuit, the data averaging circuit for determining an average of data from the digital video signal over a desired period.

12. The apparatus of claim 11 further comprising a low-pass filter coupled between the modulator circuit and the error adjusting circuit, the low-pass filter filtering low frequency signal.

13. The apparatus of claim 10, wherein the resistor layer is made out of silicon carbide.

14. The apparatus of claim 10, wherein the converter circuit is further for converting the digital video signal from a voltage-based to a current-based signal.

15. The apparatus of claim 10, wherein the error adjusting circuit comprises:

a first operational amplifier (first op-amp);

a feedback resistor connected between the negative (−) input and an output of the first op-amp; and an output resistor connected to the output of the first op-amp and to the feedback resistor, at one end and wherein the negative (−) input of the first op-amp is connected to the performance indication signal and the output resistor is connected to the column electrodes and the inverting circuit, at the other end.

16. The apparatus of claim 15, wherein the inverting circuit comprises:

a second operational amplifier (second op-amp);

a first resistor connected to the output of the first op-amp and a negative (−) input of the second op-amp; and a second resistor connected between the negative (−) input and an output of the second op-amp and wherein a positive (+) input of the second op-amp is connected to ground and the output of the second op-amp is connected to the row electrodes.

17. A method to compensate for brightness variations of a panel display during operation, the method comprising the steps of:

generating a performance indication signal by a sample display circuit having substantially similar operating characteristics as the panel display wherein the panel display is a flat panel field emission display (FED) and wherein the FED further comprises a resistor layer electrically connected to row electrodes, wherein the resistor layer is made out of silicon carbide and wherein the sample display circuit comprises a sample cathode, emitters, a sample gate, and a sample anode and wherein the performance indication signal indicates electrical variations of the sample display circuit attributed to a temperature variation thereof;

determining a difference signal from the performance indication signal received from the sample display circuit and a reference signal;

providing the difference signal to the panel display and the sample display circuit;

inverting the polarity of the difference signal; and providing the inverted difference signal to the panel display and the sample display circuit;

compensating for brightness variations of the panel display by driving row lines and column lines of the panel display with the difference signal and the inverted difference signal.

18. The method of claim 17, wherein the sample cathode comprises sample row electrodes and a sample resistor layer made out of silicon carbide.

19. A method to compensate for brightness variations of a panel display having a resistor layer made from a resistor material, the method comprising the steps of:

conducting a signal across a sample resistor, the sample resistor connected to a first voltage, the sample resistor made from the resistor material;

determining a difference signal between the signal conducted across the sample resistor and a reference signal wherein the signal conducted across the sample resistor varies according to temperature changes of the sample resistor;

providing the difference signal to the panel display wherein the panel display is a flat panel field emission display (FED) and wherein the resistor material is silicon carbide;

inverting the polarity of the difference signal;

providing the inverted difference signal to the panel display; and compensating for brightness variations of the panel display attributed to temperature changes by driving row lines and column lines of the panel display with the difference signal and the inverted difference signal.

20. A method to compensate for brightness variations of a panel display during operation, the method comprising the steps of:

a video/display controller generating a digital video signal;

converting the digital video signal to an analog video signal;

modulating the analog video signal based on a brightness duty cycle signal;

determining a difference signal from the modulated analog video signal and a performance indication signal from the panel display wherein the panel display is a flat panel field emission display (FED) and wherein the performance indication signal represents changes in electrical characteristics of the panel display attributed to temperature changes thereof;

providing the difference signal to the panel display;

inverting the polarity of the difference signal;

providing the inverted difference signal to the panel display;

compensating for brightness variations of the panel display attributed to temperature changes by driving row lines and column lines of the panel display with the difference signal and the inverted difference signal; and data averaging the digital video signal;

low-pass filtering the modulated analog video signal; and converting the digital video signal from a voltage-based to current based signal.

* * * * *